US010072834B2

(12) United States Patent
Kjaer et al.

(10) Patent No.: US 10,072,834 B2
(45) Date of Patent: Sep. 11, 2018

(54) COOLING MODULE FOR LED LIGHT FIXTURE

(71) Applicant: Martin Professional APS, Aarhus (DK)

(72) Inventors: Lars Barslund Kjaer, Hovedgaard (DK); Carlsten Dalsgaard, Silkeborg (DK)

(73) Assignee: MARTIN PROFESSIONAL APS, Aarhus (DK)

( * ) Notice: Subject to any disclaimer, the term of this patent is extended or adjusted under 35 U.S.C. 154(b) by 418 days.

(21) Appl. No.: 14/678,896

(22) Filed: Apr. 3, 2015

(65) Prior Publication Data

US 2015/0285483 A1 Oct. 8, 2015

(30) Foreign Application Priority Data

Apr. 4, 2014 (DK) ..... 2014 70172

(51) Int. Cl.
*F21V 29/67* (2015.01)
*F21V 29/83* (2015.01)
(Continued)

(52) U.S. Cl.
CPC ..... *F21V 29/677* (2015.01); *F21V 21/15* (2013.01); *F21V 21/30* (2013.01); *F21V 29/503* (2015.01); *F21V 29/673* (2015.01); *F21V 29/70* (2015.01); *F21V 29/83* (2015.01); *F21W 2131/406* (2013.01); *F21Y 2115/10* (2016.08)

(58) Field of Classification Search
None
See application file for complete search history.

(56) References Cited

U.S. PATENT DOCUMENTS 4,701,833 A 10/1987 Bornhorst
8,858,028 B2 * 10/2014 Kim ..... F21V 29/004 362/249.02
(Continued)

FOREIGN PATENT DOCUMENTS

CN 1584733 A 2/2005
CN 1875218 A 12/2006
(Continued)

OTHER PUBLICATIONS

Extended European Search Report for Application No. 15162167.9, dated Sep. 3, 2015, 5 pages.

*Primary Examiner* — Sharon Payne
(74) *Attorney, Agent, or Firm* — Artegis Law Group, LLP

(57) ABSTRACT

Various embodiments relate to a cooling module for cooling a plurality of LEDs that includes a heat sink having a LED side sand a cooling side arranged at opposite sides of the heat sink. The LEDs arranged on the LED side and a first flow channel and second cooling channel are arranged adjacent to each other at the cooling side. The cooling module comprises a first blower and a second blower respectively configured to blow cooling air in a first flow direction through the first flow channel in a second flow direction through the second flow channel, where the first flow direction and the second flow direction being opposite each other. Certain embodiments also related to the light fixture comprising such cooling module and approaches for cooling a plurality of LEDs.

20 Claims, 7 Drawing Sheets

(51) Int. Cl.

| | |
|---|---|
| ***F21V 29/503*** | (2015.01) |
| ***F21V 21/15*** | (2006.01) |
| ***F21V 21/30*** | (2006.01) |
| ***F21V 29/70*** | (2015.01) |
| *F21W 131/406* | (2006.01) |
| *F21Y 115/10* | (2016.01) |

(56) References Cited

U.S. PATENT DOCUMENTS

| | | | | |
|---|---|---|---|---|
| 2003/0048634 | A1 | 3/2003 | You et al. | |
| 2004/0150983 | A1 | 8/2004 | Sexton et al. | |
| 2004/0202006 | A1 | 10/2004 | Pien | |
| 2006/0002105 | A1 | 1/2006 | Hinojosa | |
| 2006/0082271 | A1* | 4/2006 | Lee | F21V 29/02 313/35 |
| 2006/0227558 | A1 | 10/2006 | Osawa et al. | |
| 2007/0132353 | A1* | 6/2007 | Gijzen | F21V 29/02 313/113 |
| 2007/0253198 | A1 | 11/2007 | Pelegrin | |
| 2008/0137324 | A1 | 6/2008 | Pastore | |
| 2008/0219017 | A1 | 9/2008 | Cruickshank | |
| 2009/0160344 | A1* | 6/2009 | Hsu | F21K 9/00 315/117 |
| 2009/0257221 | A1 | 10/2009 | Patterson | |
| 2010/0046246 | A1 | 2/2010 | Bihr et al. | |
| 2010/0079974 | A1 | 4/2010 | Kruger et al. | |
| 2010/0302769 | A1 | 12/2010 | Horng et al. | |
| 2011/0249443 | A1* | 10/2011 | Jurik | F21V 3/02 362/294 |
| 2013/0182436 | A1 | 7/2013 | Payne et al. | |
| 2013/0201686 | A1 | 8/2013 | Dalsgaard et al. | |

FOREIGN PATENT DOCUMENTS

| | | | |
|---|---|---|---|
| JP | 2004-191742 | A | 7/2004 |
| WO | 201010069327 | A1 | 6/2010 |
| WO | 2011076219 | A1 | 6/2011 |
| WO | 2012167798 | A1 | 12/2012 |
| WO | 2013/036538 | A1 | 3/2013 |

* cited by examiner

COOLING MODULE FOR LED LIGHT FIXTURE

CROSS-REFERENCE TO RELATED APPLICATIONS

This application claims priority to Danish Application No. PA201470172, titled, "COOLING MODULE FOR LED LIGHT FIXTURE," and filed Apr. 4, 2014. The subject matter of this related application is hereby incorporated herein by reference.

FIELD OF INVENTION

Embodiments of the present invention relate to an illumination device where a number of light sources are arranged on a heat sink and adapted to emit light in substantially the same direction.

BACKGROUND

In order to create various light effects and mood lighting in connection with concerts, live shows, TV shows, sport events or as a part of an architectural installation light fixtures creating various effects are getting more and more used in the entertainment industry. Typically entertainment light fixtures creates a light beam having a beam width and a divergence and can for instance be wash/flood fixtures creating a relatively wide light beam with a uniform light distribution or it can be profile fixtures adapted to project image onto a target surface.

Light emitting diodes (LED) are, due to their relatively high efficiency and/or low energy consumption, long lifetime, and capability of electronic dimming, becoming more and more used in connection with lighting applications. LEDs are used in lighting applications for general illumination such as wash/flood lights illuminating a wide area or for generating wide light beams e.g. for the entertainment industry and/or architectural installations. For instance like in products such as MAC 101™, MAC 301™, MAC 401™, MAC Aura™, MAC Quantum™ Wash, Stagebar2™, Easypix™, Extube™, Tripix™, Exterior 400™ series provided by the applicant, Martin Professional. Further LEDs are also being integrated into projecting systems where an image is created and projected towards a target surface. For instance like in the product MAC 350 Entrour™ provided by the applicant, Martin Professional.

The lifetime and performance of the LEDs depends on the operating temperature of the LED and both lifetime and performance drops dramatically with increasing operating temperature. One of the challenges when cooling LED are the fact that critical temperature of the LEDs in relation the temperature of the surroundings are relatively small (40-70 degrees) and the cooling effect of using ambivalent air is thus not very high. Further when providing projecting LED devices where the light is focused through an optical gate with an imaging object the LEDs are arranged very close together and generates thus much heat in a small area. Several prior art cooling systems have tried to solve this issue, however none of these have yet be found good enough when arranging a significant amount (+20) of LED close together in an array.

WO10069327A1 discloses a moving head light fixture, which moving head light fixture comprises a light generating head, which head is carried in a yoke, which head is rotatable to the yoke, which yoke is rotatable to a base, which head comprises at least one electronic circuit for LED control, where the moving head comprises a first cooling plate comprising a number of LEDs; a second cooling plate comprising said at least one electronic circuit for LED control; and an air flow passage running from at least one end of said moving head, through at least said first cooling plate and/or said second cooling plate and between said first cooling plate and said second cooling plate. The length of the cooling module according to WO20069327 is relatively large, as the electronic circuits for LED control are arranged a distance behind the LEDs in order to provide a flow channel there between. This is not desired in connection with projecting devices where the light is coupled through an optical gate, as the optical systems of such devices are long in order to provide good optical system. The length of head in a moving head light fixture is of the limited due to physical limitations/specifications and it is thus desired to provide a shorter cooling module.

WO11076219A1 discloses a illumination device comprising a number of light sources and a number light collecting means, where the light collecting means collect light generated by the first light sources and convert the light into a source light beam propagating primarily along a primary optical axis. The light source module comprises a cooling module comprising a number of interconnected plane mounting surfaces angled in relation to each other and where the light sources is arranged on said plane mounting surfaces. The cooling module comprises a first side comprising the mounting surfaces and a second side comprising a number of cooling fins defining a number of radial air channels. The length of the cooling module according to WO11076219 is relatively large, as the fan must be arranged at the center part of the cooling module. Further such cooling module is difficult to provide in light fixtures comprising a large number (+20) of LEDs as individual mounting surfaces must then be provided.

WO12167798A1 discloses an illumination device where a number of light sources are arranged on a heat sink and adapted to emit light in substantially the same direction. The heat sink comprises a first cooling plate and a second cooling plate and a first part of the light sources are arrange on the first cooling plate and a second part of the light sources are arranged on the second cooling plate. The first and second cooling plates are further separated by a distance and a flow channel is defined there between. The flow channel allows cooling fluid to flow between the first cooling plate and the second cooling plate whereby the light sources can be cooled by the cooling fluid. The heat sink comprises further a number of light passages allowing light to propagate from the second cooling plate, towards the first cooling plate and through the first cooling plate. WO12167798A1 relates also to a method of cooling light sources emitting light in substantially the same direction. The length of the cooling module according to WO12167798A1 is relatively large, as the LEDs are arranged at two separate PCBs where between a cooling channels is provided.

SUMMARY

At least one objective of the claimed embodiments is to solve the above described limitations related to the prior art by providing a thin and compact cooling module which efficiently can cool a large number of LEDs. This is achieved by a cooling module comprising a heat sink where on the LEDs are mounted as described in the independent claims. The dependent claims describe possible embodiments of the present invention. The advantages and benefits of the present invention are described in the detailed description of the invention.

SHORT DESCRIPTIONS OF THE DRAWINGS

DETAILED DESCRIPTION

Different embodiments are described in view of certain exemplary implementations that are only intended to illustrate the principles of the claimed embodiments. The skilled person will be able to provide several embodiments within the scope of the claims. In the illustrated embodiments the illustrated light beams and optical means do only serve to illustrate the principles of the claimed embodiments rather than illustrating exact and precise light beams and optical means.

Figure 1A:
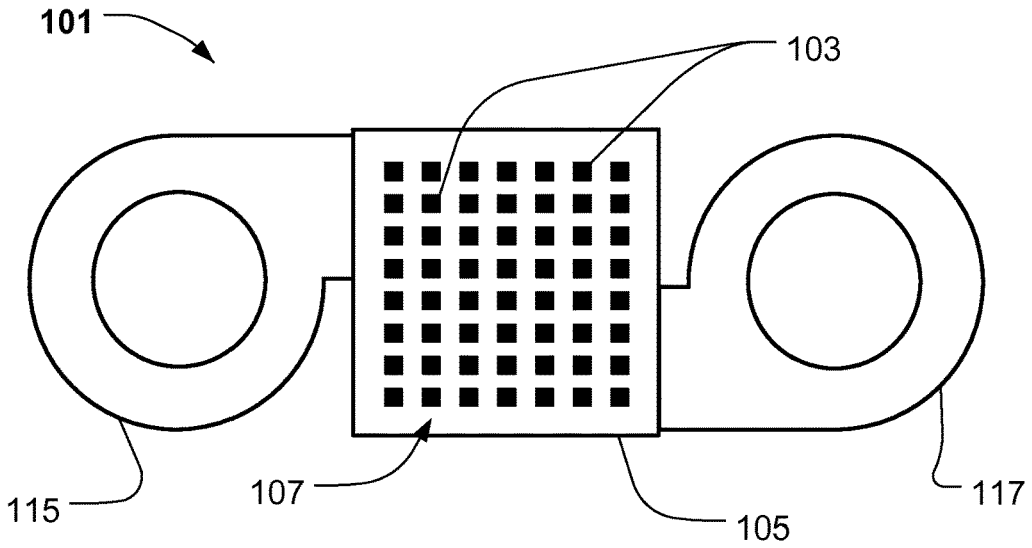
FIG. 1A-1C illustrate a structural diagram of a cooling module, according to various embodiments.
Figure 1B:
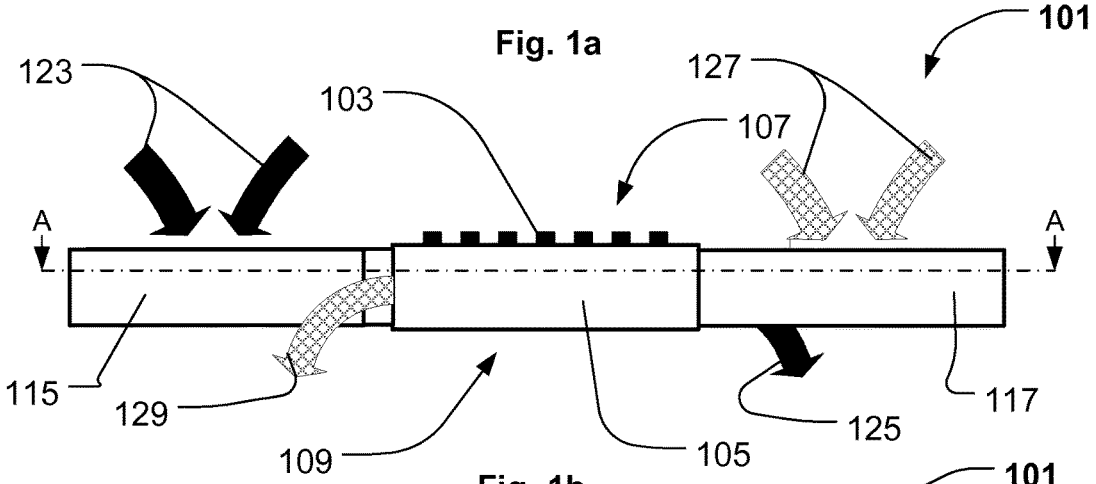
Figure 1C:
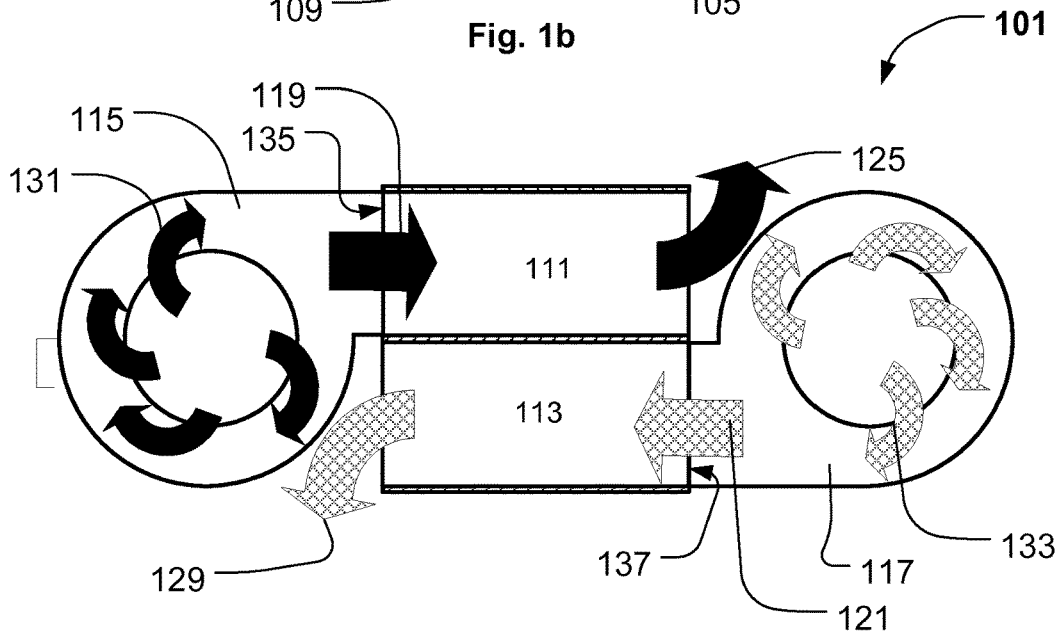

FIG. 1*a*-1*c* illustrate a structural diagram of a cooling module 101, according to various embodiments, where FIG. 1*a* illustrates a top view (seen from the LED side); FIG. 1*b* illustrates a front view and FIG. 1*c* illustrate a cross sectional view through line A-A in FIG. 1*b*.

The cooling module comprises a plurality of LEDs 103 (illustrated as black quadrangles) generating light. It is to be understood that the LEDs can be any kind of LED configured to generate light, and can for instance be single die LEDs or multiple die LEDs known as 4in1 (RGBW) or 3in1 (RGB) LED. Further the LEDs can be any kind of light emitting diode including but not limited to solid state LEDs (Light Emitting Diodes, OLEDs (Organic Light Emitting diodes), PLEDs (Polymer Light Emitting Diodes) and/or phosphor based LEDs. In the illustrated embodiment the LEDs are arranged in a rectangular array; however it is to be understood that the LEDs can be arranged in an array having any shape and that the shape of the array can be designed based on the optical requirements to the light fixture.

The cooling module 101 comprises a heat sink 105 having a LED side 107 and a cooling side 109, where the LEDs 103 are arranged on a LED side 107 (in the illustrated embodiment top side) of the heat sink. The heat sink comprises a first flow channel 111 arranged at the cooling side 109 and a second flow channel 113 arranged at the cooling side 109. The first flow channel 111 and the second flow channel 113 are arranged adjacent each other at the cooling side. The cooling module comprises a first blower 115 and a second blower 117. The first blower 115 is configured to blow cooling air in a first flow direction 119 through the first flow channel 111 and the second blower 117 is adapted to blow cooling air through said second flow channel 113 in a second flow direction 121, where the first flow direction and the second flow direction being opposite each other.

The illustrated cooling module is very compact in the longitudinal direction (from top to bottom) as the blower does not take up mush space behind the LEDs. Further a very efficient cooling effect is provided as the blower blows cooling air directly through the flow channels wherein the heat from the LED will be dissipated. Providing the flow channels ensure that the cooling air is kept in contact with the cooling side of the heat sink whereby more heat is removed. Providing two cooling channels wherein the cooling air flows in opposite directions ensure that the LEDs are equally cooled as both sides of the LED array are cooled by the coolest cooling air. Further by providing two adjacent linear flow channels ensures a fast flow of cooling air, as the flowing cooling air can flow more smooth through linear flow channels. Additionally providing two flow channels makes it possible to provide a height as at least one blower can be provided for each flow channel more air blowing power can thus be provided. As a consequence more heat can be removed.

Further, in the illustrated embodiment the first blower 115 is configured to blow air from the LED side 107 of the heat sink as illustrated by arrows 123 into and through the first cooling channel, as illustrated by arrow 119. Thereafter the cooling air is led out of the first flow channel at the cooling side of the heat sink as illustrated by arrow 125. Similar the second blower 117 is configured to blow air from the LED side 107 of the heat sink as illustrated by arrows 127 into and through the second cooling channel as illustrated by arrow 121. Thereafter the cooling air is led out of the second flow channel at the cooling side of the heat sink as illustrated by arrow 129.

The first blower 115 and second blower 117 are both radial blower where a fan (not shown) are configured to suck cooling air in at the center and force the cooling air in a circular direction as illustrated by arrows 131 and 133 in FIG. 1*c*. The blowers blow thereafter the cooling air out of outlets 135 and 137. Typically the outlet of a radial blower is arranged tangential to the circular direction as a consequence the radial fans can be rotated 180 degrees in relation to each other and their outlets can thus be arranged to blow cooling air in opposites directions. At the same time the outlet of the flow channels can be provided just beside outlet of the blower blowing air into the other flow channel, as there is space for cooling air to escape the flow channel in the space between the flow channel outlet and the radial blower. The radial blowers are further relatively thin and the height of the flow channels and radial blower can be configured to be substantial (the difference does not exceed 10%) identical. As a consequence a very compact and thin cooling module can be provided.

Alternatively to having two blowers, it is possible to implement the present invention having one blower and where a system of ducts and tubes is configured to direct cooling air from the blower and into the first and second cooling channels from two opposite directions. Further it is also notice that other kind of blower's such as axial fans also can be used.

In the illustrated embodiment the first and second flow channels are linear which results in the fact that the cooling air easier can flow through the cooling channels as the cooling air does not expires changes in flow direction which slows the flow of cooling air. It is noticed that the cooling channels also can comprise a number of cooling fins extending into the interior of the cooling channels. The cooling fins will dissipate heat from the LEDs into the cooling channels where the cooling air will remove the heat. In one embodiment the cooling fins inside the cooling channels is embodied as linear cooling fins extending along the flow direction of the cooling air. The linear cooling fins can in one embodiment form a number of linear sub flow channels inside the first flow channel and/or inside the second flow channel. The cooling fins provide better cooling as the contact area between the cooling air and the heat sink is increased. Additional the linear cooling fins ensures that a large flow of cooling air can be maintained through the flow channels as the cooling air does not meet any obstacles inside the linear flow sub-channels. For instance it is avoided that the cooling air is decelerated due the fact that it must perform a 90 degree turns in order to be guided into radial air channels as the case in the prior art (WO11076219, WO10069327).

Figure 2:
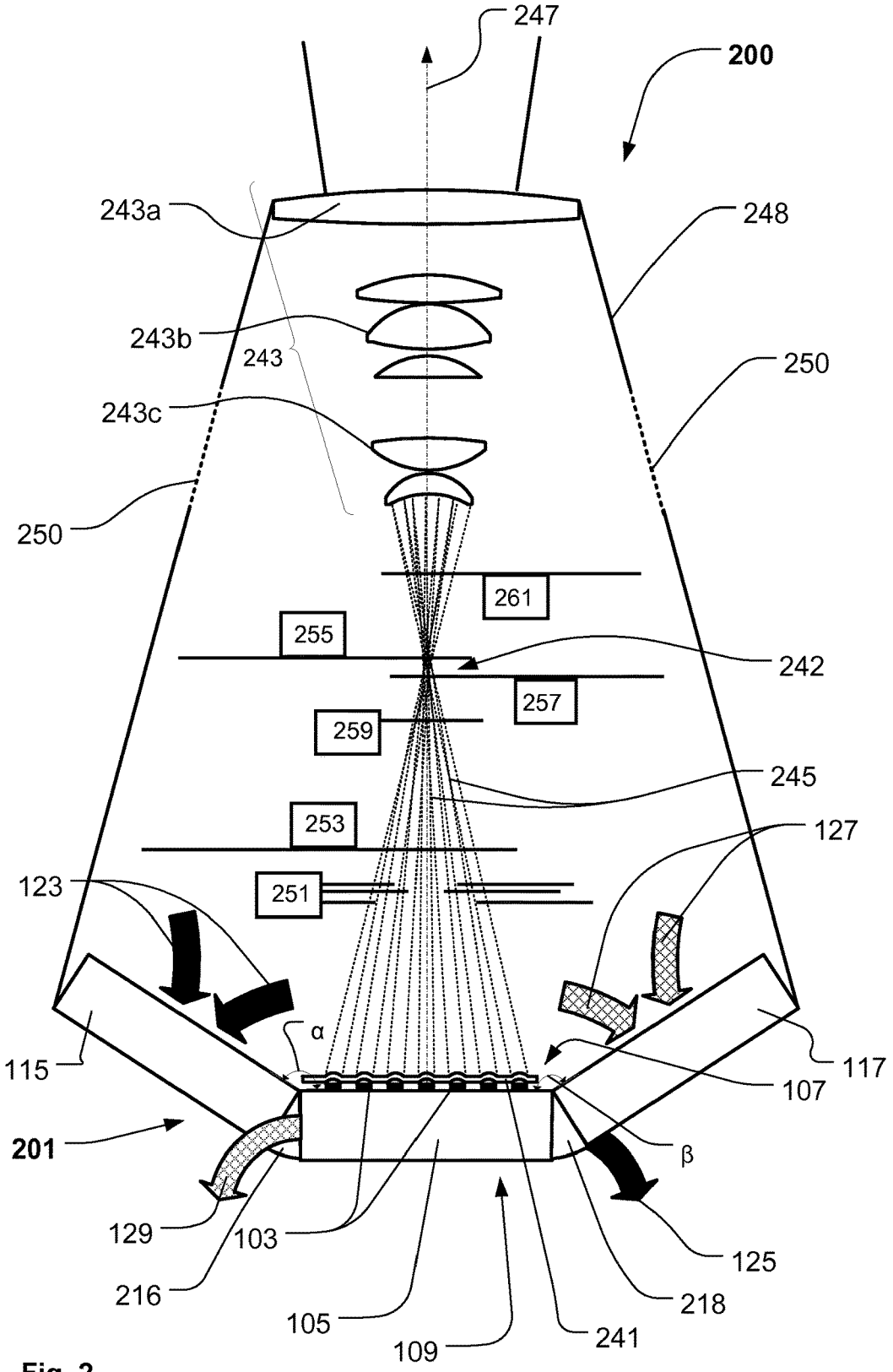
FIG. 2 illustrates a structural diagram of a light fixture comprising a cooling module, according to various embodiments.

FIG. 2 illustrates a structural diagram of an illumination device 200 comprising a cooling module 201, according to various embodiments.

The illumination device comprises a cooling module 201 comprising a plurality of LEDs 103, a light collector 241, an optical gate 242 and an optical projecting and zoom system 243.

The cooling module is substantially identical to the cooling module shown in FIGS. 1*a*-1*c*. Identical features are labeled with the same references as in FIG. 1*b*-1*c* and will not be described further, however the differences will be described below. The cooling module is arranged in the bottom part of a lamp housing 248 of the illumination device and the other components are arranged inside the lamp housing 248.

As described in connection with FIG. 2 the blowers 115 and 117 are configured to force cooling air from the LED side of the heat sink, through the flow channels and out of the flow channels at the outside of the lamp housing. The lamp housing 248 can be provided with a number of openings 250 at the LED side of the heat sink. The openings 250 allow cooling air to be sucked into the housing and the cooling air can then be blown out of lamp housing through the flow channels. The openings 250 can be arrange at a position away from the outlets of the flow channels in order to avoid hot air to be sucked into the housing and be used as cooling air, which will reduce the heat capacity of the cooling air. Similar sucking cooling air from the space in front of the LED and letting the cooling air out at the other side reduces the risk the LED are being heated by the used (and hot) cooling air.

The light collector 241 is adapted to collect light from the LEDs 103 and to convert the collected light into a plurality of light beams 245 (dotted lines) propagating along an optical axis 247 (dash-dotted line). The light collector can be embodied as any optical means capable of collecting at least a part of the light emitted by the LEDs and convert the collected light to a light beams. In the illustrated embodiment the light collector comprises a number of lenses each collecting light from one of the LEDs and converting the light into a corresponding light beam. However it is noticed that the light collector also can be embodied a single optical lens, a Fresnel lens, a number of TIR lenses (total reflection lenses), a number of light rods or combinations thereof. It is understood that light beams propagating along the optical axis contain rays of light propagating at an angle, e.g. an angle less that 45 degrees to the optical axis.

The light collector may be configured to fill the optical the gate 242 with light from the light sources 103 so that the area, i.e. the aperture, of the gate 242 is illuminated with a uniform intensity or optimized for max output. The gate 242 is arranged along the optical axis 247.

The optical projecting system 243 may be configured to collect at least a part of the light beams transmitted through the gate 242 and to image the optical gate at a distance along the optical axis. For example, the optical projecting system 243 may be configured to image the gate 242 onto some object such as a screen, e.g. a screen on a concert stage. A certain image, e.g. some opaque pattern provided on a transparent window, an open pattern in a non-transparent material, or imaging object such as GOBOs known in the field of entertainment lighting, may be contained within the gate 242 so that that the illuminated image can be imaged by the optical projecting system. Accordingly, the illumination device 200 may be used for entertainment lighting.

In the illustrated embodiment the light is directed along the optical axis 247 by the light collector 241 and passes through a number of light effects before exiting the illumination device through a front lens 243*a*. The light effects can for instance be any light effects known in the art of intelligent/entertainments lighting for instance, a CMY color mixing system 251, color filters 253, gobos 255, animation effects 257, iris effects 259, a focus lens group 243*c*, zoom lens group 243*b*, prism effect 261, framing effects (not shown), or any other light effects known in the art. The mentioned light effects only serves to illustrate the principles of an illuminating device for entertainment lighting and the person skilled in the art of entertainment lighting will be able to construct other variations with additional are less light effects. Further it is noticed that the order and positions of the light effects can be changed.

The illumination device comprises a cooling module 201 substantially identical to the cooling module shown in FIGS. 1*a*-1*c*. Identical features are labeled with the same references as in FIG. 1*b*-1*c* and will not be described further. However in this embodiment the first 115 and second 117 blowers are arranged at an angle in relation to the LED 107 side of the heat sink 105 and the angle α, β between the blowers and the LED side is less than 180 degrees. The blowers have thus been turned in a direction upwardly (in the drawing) in relation to the heat sink and at least a part of the blower are protruding upwardly in relation the to the LED side of the heat sink. The angle between the LED side of the heat sink and the first blower are indicated as a in FIG. 2 and the angle between the LED side of the heat sink and the second blower is indicated as β in FIG. 2. By angling the blowers upwardly in relation to the LED side of heat sink makes it possible to reduce the cross sectional dimensions of the cooling module. However the cooling module does not take up more space backward due to the angling in direction of the LED side of the heat sink. In fact the consequence of the angling upwardly results in the fact that more free space is provided at the lower and outer parts below the cooling module. A flow channel turn 216 has been provided between the outlet of the first blower 115 and the first flow channel 111, similar a flow channel turn 218 has been provided between the outlet of the second blower 117 and the second flow channel 113. The flow channel turn are provided in order to guide the cooling from the outlet of the blower and into the cooling channel and provided as walls in for instance in polymer, metal, wood or other suitable material.

A good compromise between additional space and cooling effect can be provided if the angle α, β between the blowers 115, 117 and the LED side 107 of the heat sink is at least 110 degrees and less than 160 degrees. If the blower is angled at least 110 degrees in relation to the flow channel the air flow from the blower and into the flow channels is not decreased significantly due to the turn in the air flow channel between the blower and the flow channel. Further a usable amount of additional space is also provided at angles less than 160 degrees.

Alternatively the angle α, β between the blowers 115, 117 and the LED side 107 of the heat sink is at least 115 degrees and less than 125 degrees. In this range of angles a significant amount of additional space is provide and whiles the air flow is not decreased significantly due the flow channel turns.

As will be described in connection with FIG. 3 the angling of the blower in relation to the heat sink is useful when using the illumination device as a head in a moving head light fixture, as the space between the yoke arms of the is limited.

Figure 3:
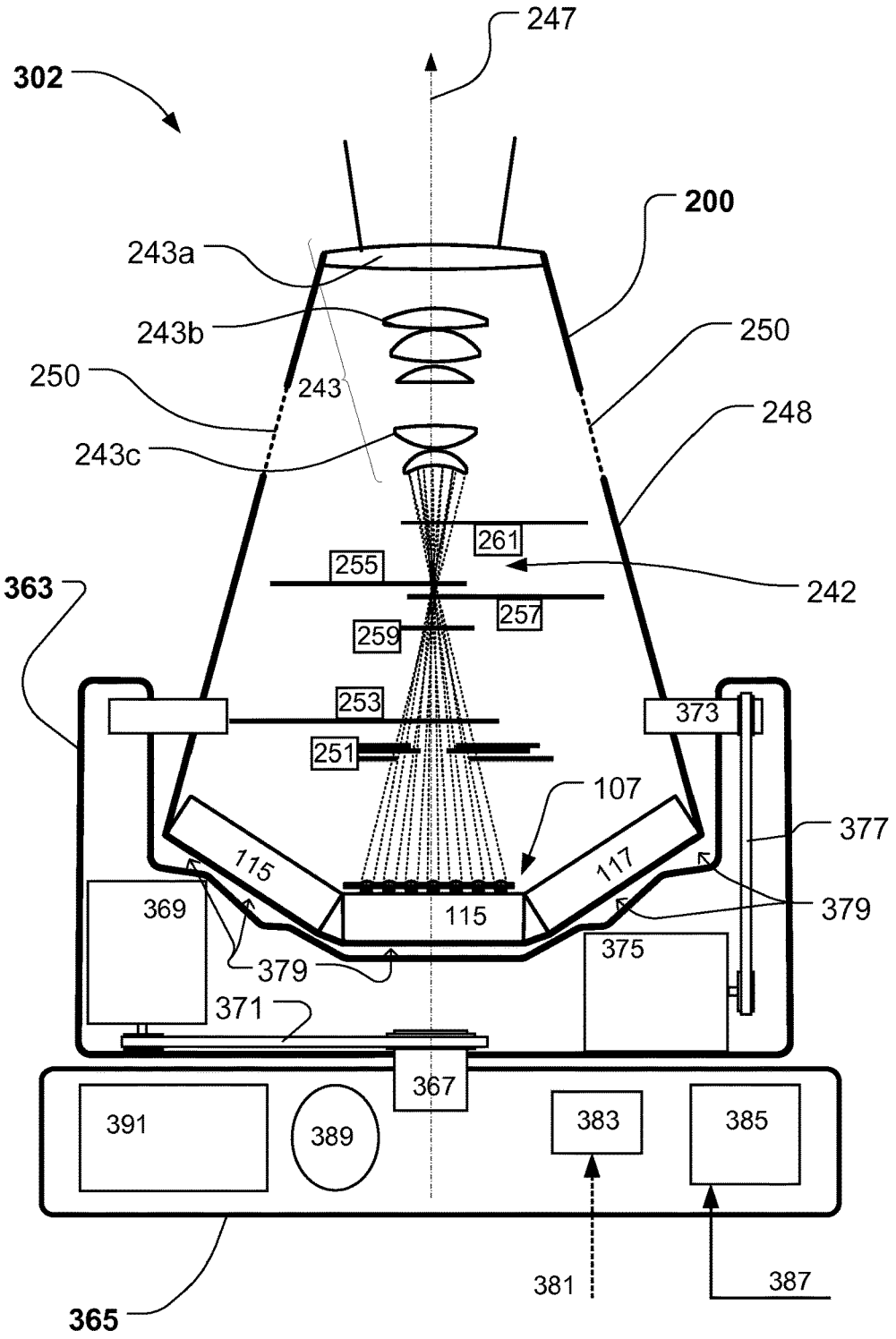
FIG. 3 illustrates a structural diagram of a moving head light fixture comprising a cooling module, according to various embodiments.

FIG. 3 illustrates a structural diagram of a moving head light fixture 302 comprising a head 200 rotatable connected to a yoke 363 where the yoke is rotatable connected to a base 365.

The head is substantially identical to the illumination device shown in FIG. 2 and substantial identical features are labeled with the same reference numbers as in FIGS. 1*b*-1*c* and 2 will not be described further.

The moving head light fixture comprises pan rotating means for rotating the yoke in relation to the base, for instance by rotating a pan shaft 367 connected to the yoke and arranged in a bearing (not shown) in the base). A pan motor 369 is connected to the shaft 367 through a pan belt 371 and is configured to rotate the shaft and yoke in relation to the base through the pan belt. The moving head light fixture comprises tilt rotating means for rotating the head in relation to the yoke, for instance by rotating a tilt shaft 373 connected to the head and arranged in a bearing (not shown) in the yoke). A tilt motor 375 is connected to the tilt shaft 373 through a tilt belt 377 and is configured to rotate the shaft and head in relation to the yoke through the tilt belt. The skilled person will realize that the pan and tilt rotation means can be constructed in many different ways using mechanical components such as motors, shafts, gears, cables, chains, transmission systems, bearings etc. Alternatively it is noticed that it also is possible to arrange the pan motor in the base and/or arrange the tilt motor in the head.

The space 379 between the yoke and the bottom part of the head is limited as the moving head light fixture is designed to be as small as possible. By angling the blowers as described in connection with FIG. 2 makes it possible to provide a more compact moving head light fixture as at least a part of the step motors can be allowed to extend into the space between the bottom part of the head and the yoke arms. This is possible as the angled blowers do not take up space at the side and bottom part of the head. As a consequence it is possible to provide thinner yoke arms as the pan and tilt motor can be arranged in the bottom part of the yoke and allowed to partially protrude into the additional space provide by angling the blowers in relation to the LED side of the heat sink.

As known in the prior art, the moving head light fixture receives electrical power 381 from an external power supply (not shown). The electrical power is received by an internal power supply 383 which adapts and distributes electrical power through internal power lines (not shown) to the subsystems of the moving head. The internal power system can be constructed in many different ways for instance by connecting all subsystems to the same power line. The skilled person will however realize that some of the subsystems in the moving head need different kind of power and that a ground line also can be used. The light source will for instance in most applications need a different kind of power than step motors and driver circuits.

The light fixture comprises also a controller 385 which controls the components (other subsystems) in the light fixture based on an input signal 387 indicative light effect parameters, position parameters and other parameters related to the moving head lighting fixture. The controller receives the input signal from a light controller (not shown) as known in the art of intelligent and entertainment lighting for instance by using a standard protocol like DMX, Art-NET, RDM etc. Typically the light effect parameter is indicative of at least one light effect parameter related to the different light effects in the light system. The controller 385 is adapted to send commands and instructions to the different subsystems of the moving head through internal communication lines (not shown). The internal communication system can be based on a various type of communications networks/systems.

The moving head can also comprise user input means enabling a user to interact directly with the moving head instead of using a light controller to communicate with the moving head. The user input means 389 can for instance be bottoms, joysticks, touch pads, keyboard, mouse etc. The user input means can also be supported by a display 391 enabling the user to interact with the moving head through a menu system shown on the display using the user input means. The display device and user input means can in one embodiment also be integrated as a touch screen.

Figure 4A:
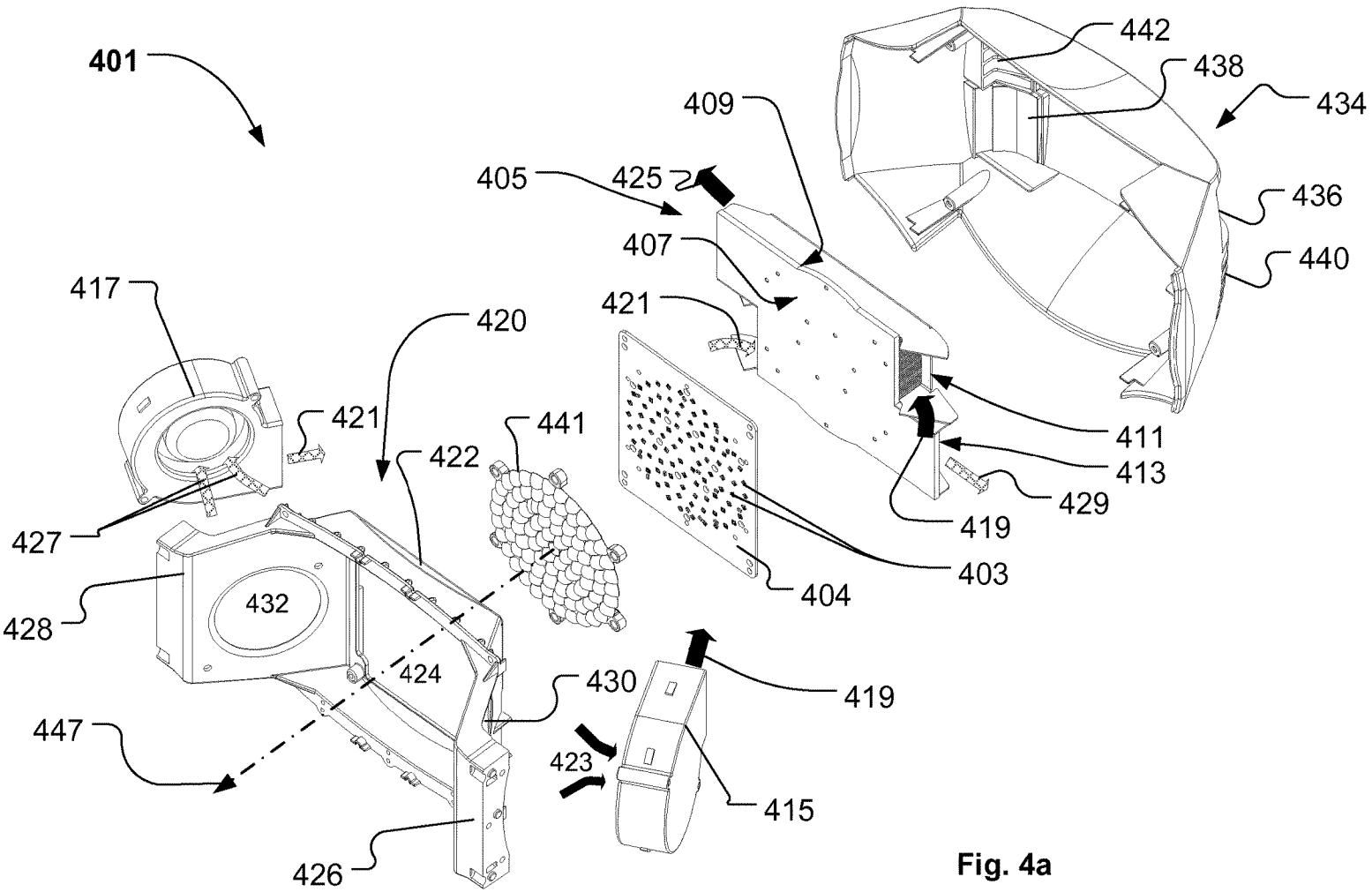
FIG. 4A-4E illustrate different views of a cooling module, according to various embodiments.
Figure 4B:
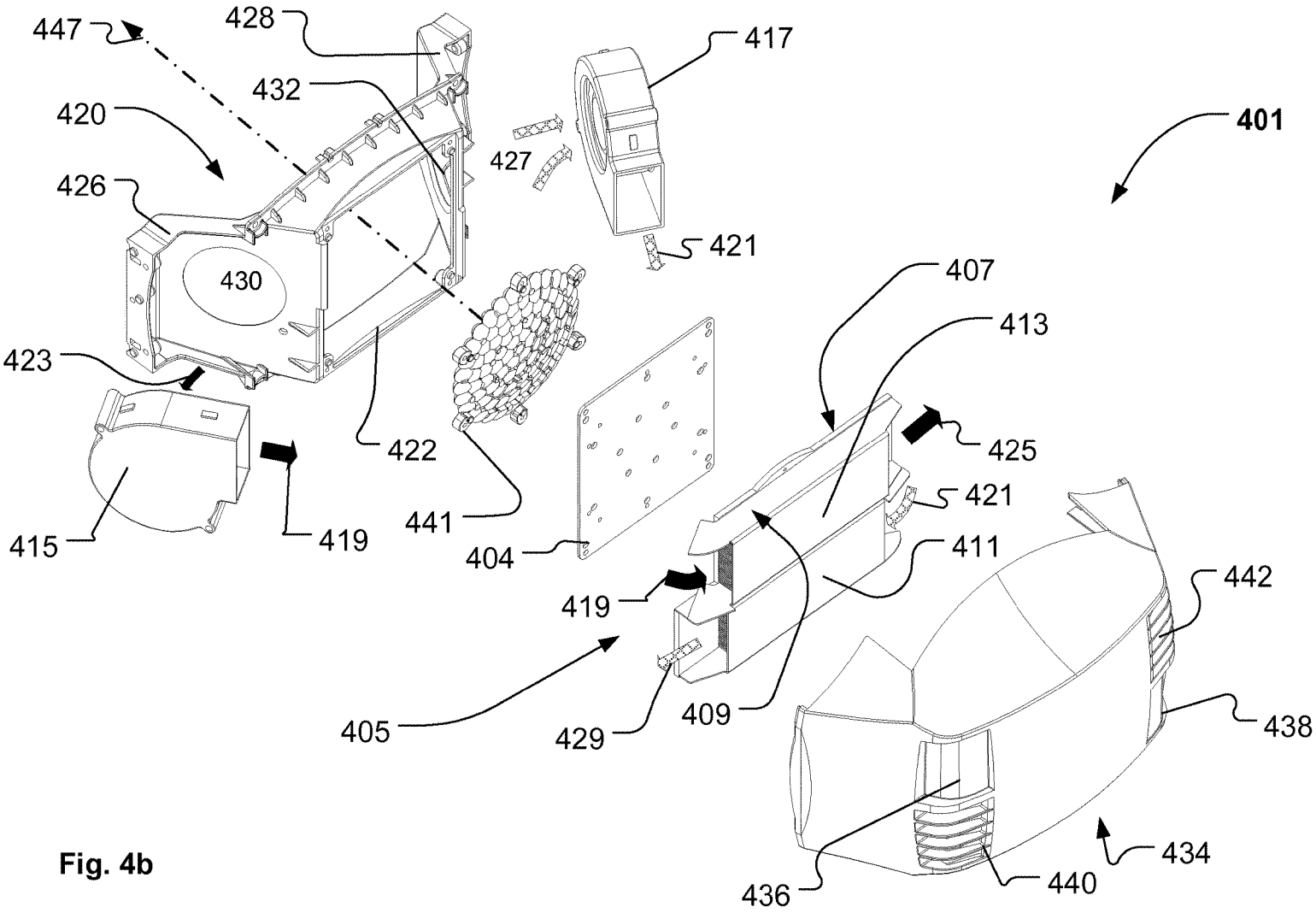
Figure 4C:
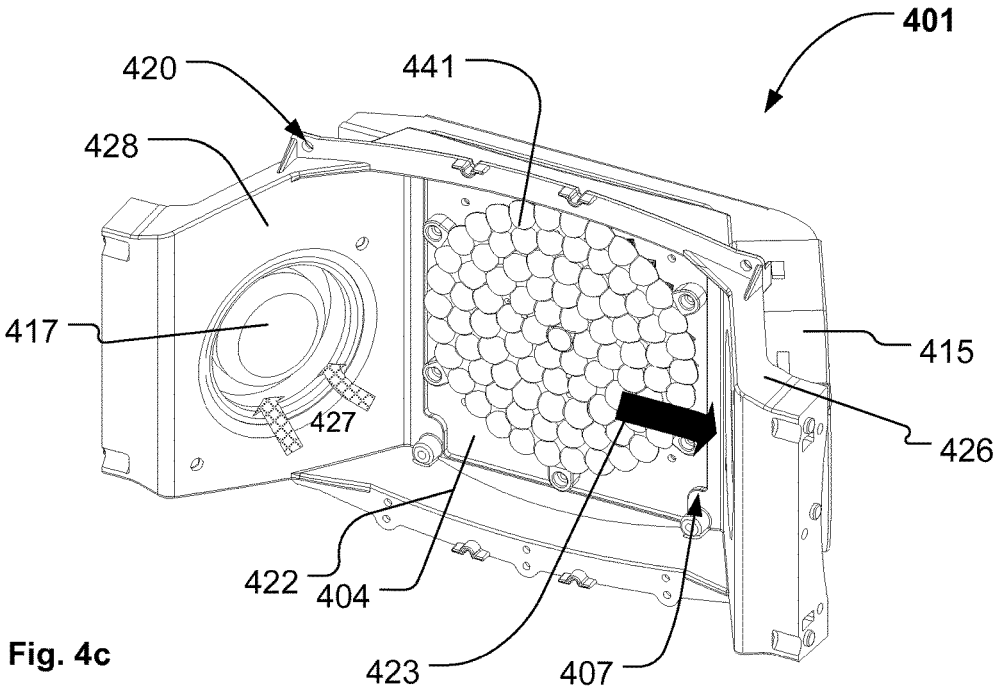
Figure 4D:
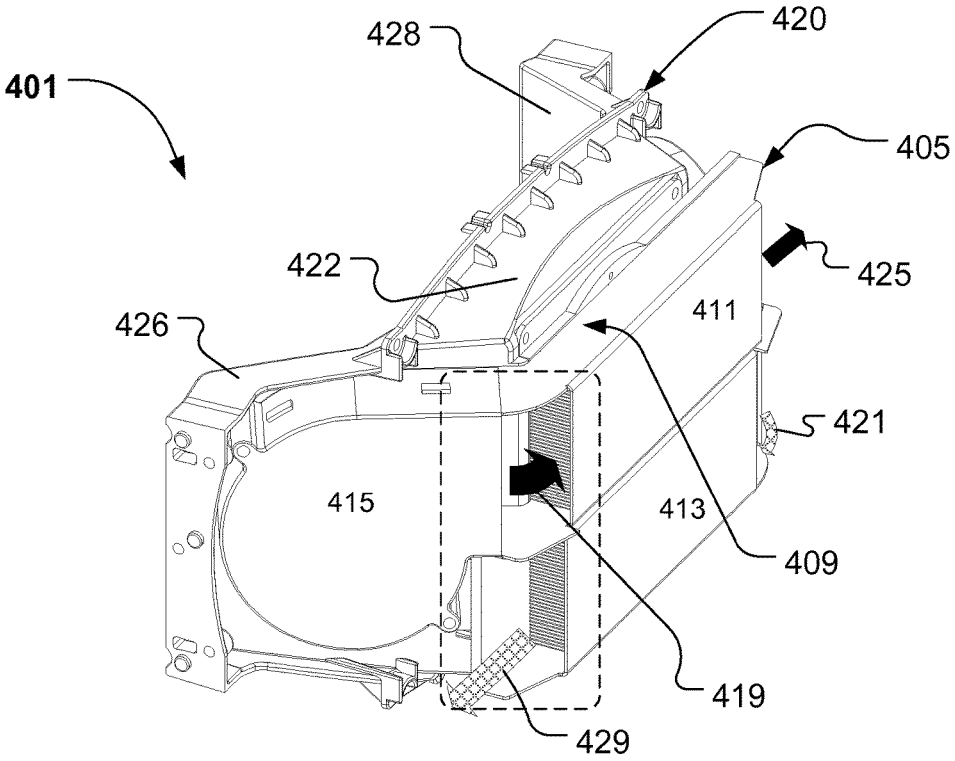
Figure 4E:
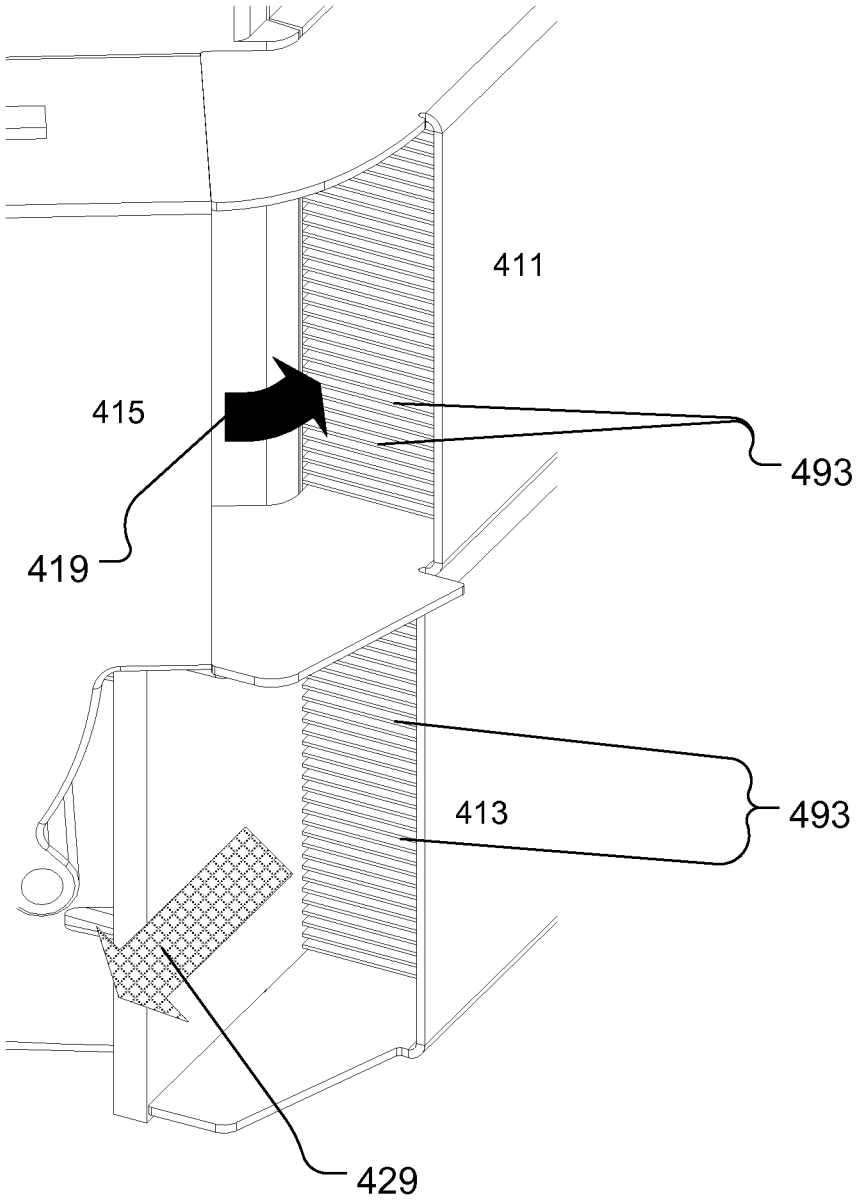

FIG. 4*a*-4*f* illustrate a cooling module 401, according to various embodiments, where FIG. 4*a* illustrates an explode view seen from the top, 4*b* illustrates an exploded view from the bottom, FIG. 4*c* illustrates a top perspective view; FIG. 4*d* illustrates a bottom perspective view and FIG. 4*e* illustrates an enlarge view of the area marked by the dashed rectangle in FIG. 4*d*.

The cooling module 401 is like the cooling module illustrated in FIGS. 1-3 and like features is labeled with the same two digits as the reference of the corresponding feature(s) having the same functionality/effect in FIGS. 1-3 and will not be described in details.

The cooling module comprises a plurality of LEDs 403 (only visible in FIG. 4*a*) arranged on a LED PCB 404. In the illustrated embodiment a total number of 90 LEDs are arranged in a substantial circular array. As a consequence much heat is generated when all LEDs are been driven at maximum power. A light collector 441 is arranged above the LEDs and is configured to collect light from the LEDs 403 and to direct the light towards an optical gate (not shown) arrange upstream the optical axis 447. In this embodiment the light collector comprises a number of lenses arranged in a substantial circular array.

The cooling module 401 comprises a heat sink 405 having a LED side 407 and a cooling side 409, where the LED PCB 404 are arranged on a the LED side 407. However it is to be understood that the LED PCB 404 can be integrated into the heat sink 405 and constitute the LED side of the heat sink for instance by providing the LED PCB 404 as a metal core PCB which is then formed as the top plate of the heat sink. This results in better heat transmission from the LEDs and to the heat sink. The heat sink comprises a first flow channel 411 arranged at the cooling side 409 and a second flow channel 413 arranged at the cooling side 409. The first flow channel 411 and the second flow channel 413 are arranged adjacent each other at the cooling side.

A first radial blower 415 is configured to blow cooling air in a first flow direction 419 through the first flow channel 411 and a second radial blower 417 is configured to blow cooling air in a second flow direction 421 through the second flow channel 413. The first blower 415 is configured to blow air from the LED side 407 of the heat sink (illustrated by arrows 423), into and through the first cooling channel (illustrated by arrows 419). Thereafter the cooling air is lead out of the first flow channel at the cooling side of the heat sink as illustrated by arrow 425. Similar the second blower 417 is configured to blow air from the LED side 407 of the heat sink (illustrated by arrows 427), into and through the second cooling channel (illustrated by arrows 421). Thereafter the cooling air is led out of the second flow channel at the cooling side of the heat sink as illustrated by arrow 429.

The cooling module comprises a mounting frame 420 whereto the heat sink 405 and the blowers 415, 417 are fixed. The mounting frame comprises main frame 422 having a central opening 424 and the heat sink 405 is fixed to the bottom side of the main frame. The LEDs 403 and light collector 441 are then arranged in the central opening 424 and can thus emit light along the optical axis 447.

The mounting frame comprises a first side frame 426 and a second side frame 428. The first and second side frames protrude from the main frame and are angled in relation to the main frame. The angles between the main frame and the side frames correspond to the angling between the blower and the flow channels as described in connection with FIGS. 2 and 3. As a consequence the blowers can easily be arranged at the desired angle in relation to the flow channels. In the illustrated embodiment the side frame comprises an opening 430, 432 allowing cooling air to be sucked into the blowers from the space between the main frame and the side frames. However it is noticed that alternatively the blowers can be configured to suck air from the opposite side and thereby suck air form the outside of the lamp housing.

The cooling module comprises an outer shell part 434 (only shown in FIGS. 4*a* and 4*b*) covering at least a part of the cooling module. The outer shell part serves as a part of the lamp housing when the cooling module is integrated into a light fixture. A part of the first flow channel turn and a part of the second flow channel turn are integrated into the outer shell part. The first and second flow channel turn parts are indicate by respectively reference number 436 and 438 and serve to guide the cooling air from the blowers into the flow channels. The outer shell part 434 comprise also a first outlet 440 and a second outlet 442 respectively arranged near the outlet of the first flow channel 411 and the outlet of second flow channel 413, whereby the cooling air can be let outside the lamp housing.

FIG. 4*e* illustrates an enlarged view of the area marked by the dashed rectangle in FIG. 4*d* and it can be seen that the first flow channel 14 and the second flow channel comprises a plurality of cooling fins 493 extending into the flow channels. In the illustrated embodiment the cooling fins are linear arranged along the flow direction of the cooling air and forms a number of sub flow channels inside the flow channels. The cooling fins increases the contact area between the cooling air and the heat sink and heat can as a consequence be removed more efficiently. Providing cooling fins along the flow directions ensures that the air flow resistance inside the flow channels is limited. Alternatively it is noticed that other shapes of cooling fins can be provided, for instance as a plurality of pin fins extending into the flow channels.

The present invention relates also to a method of cooling a plurality of LEDs where the LEDs are arranged at an LED side of a heat sink. For instance by arranging a LED PCB whereon the LEDs have been arranged on a heat sink as described above or by integrating the LED PCB comprising the LEDs into a heat sink. The method comprises the step of blowing cooling air onto a cooling side of the heat sink, where the cooling side and the LED side being arranged at opposite sides of the heat sink. E.g. by arranging at least one blower such that it blows cooling air onto the cooling side. The blower can be arranged to blow cooling air directly onto the cooling side or to blow cooling onto the cooling sides via a system of tubes and ducts.

According to the present invention the step of blowing cooling air to the cooling side of the heat sink comprises the step of blowing cooling air in a first flow direction through a first flow channel, where the first flow channel have been provided at the cooling side of the heat sink. Further the step of blowing cooling air to the cooling side of the heat sink comprises the step of blowing cooling air in a second flow direction through a second flow channel provided adjacent to the first cooling channel at said cooling side of the heat sink. The first flow direction and the second flow direction are opposite each other. As described above this makes it possible to provide a cooling module which is very compact in the longitudinal direction. Further a very efficient cooling effect is provided as the blower blows cooling air directly through the flow channels wherein the heat from the LEDs will be dissipated. Further by providing two adjacent linear flow channels ensures a fast flow of cooling air, as the flowing cooling air can flow more smooth through linear flow channels.

In one embodiment the steps of blowing cooling air through the first flow channel or blowing cooling air through the second flow channel comprises the step of blowing cooling air from the LED side into the flow channels out of said flow channels at the cooling side of the heat sink. As described above this ensures the not hot cooling air a directed onto the LEDs, as the heated cooling air is blown away from the LEDs.

The invention claimed is:

1. A cooling module for a light fixture that includes a plurality of LEDs that generate light, said cooling module comprising:

a heat sink comprising a LED side and a cooling side, where said cooling side being opposite said LED side and wherein said plurality of LEDs are arranged on a PCB at said LED side; and a first blower and a second blower, wherein at least one of the first blower and the second blower is adapted to blow cooling air to said cooling side, wherein said heat sink comprises a first linear flow channel arranged at said cooling side and a second linear flow channel arranged at said cooling side, said first flow channel and said second flow channel being arranged adjacent to each other at said cooling side, wherein said first blower is configured to blow cooling air in a first flow direction substantially parallel to the PCB through said first flow channel, and said second blower is configured to blow cooling air in a second flow direction substantially parallel to the PCB through said second flow channel, said first flow direction and said second flow direction being opposite to each other, and the cooling air in each flow channel cooling several of the plurality of LEDs, and wherein said first blower is arranged at a first angle in relation to said LED side of said heat sink, and said second blower is arranged at a second angle in relation to said LED side of said heat sink, each of said first angle and said second angle being less than 180 degrees.

2. A cooling module according to claim 1, wherein each of said first angle and said second angle is at least 110 degrees and less than 160 degrees.

3. A cooling module according to claim 1, wherein each of said first angle and said second angle is at least 115 degrees and less than 125 degrees.

4. A cooling module according to claim 1, wherein said cooling module comprises a first flow channel turn connecting the outlet of said first blower and said first flow channel, and a second flow channel turn connecting the outlet of said second blower and said second flow channel.

5. A cooling module according to claim 1, wherein an outlet of said first flow channel is provided beside the outlet of said second blower and an outlet of said second flow channel is provided beside the outlet of said first blower.

6. A cooling module according to claim 1, wherein at least one of said first blower and said second blower is configured to blow cooling air from said LED side of said heat sink into and through at least one of said first flow channel or said second flow channel, and at least one of said first flow channel or said second flow channels comprises an outlet at said cooling side of said heat sink and is configured to lead said cooling air out of said outlet.

7. A cooling module according to claim 1, wherein said cooling module comprises a mounting frame comprising a main frame, a first side frame and a second side frame, wherein said first side frame and said second side frame are angled in relation to said main frame, said main frame comprising a central opening, and said heat sink is fixed to said main frame such that said LEDs are arranged in said central opening, and wherein said first blower is arranged at said first side frame and said second blower is arranged at said second side frame.

8. A cooling module according to claim 7, wherein said first side frame comprises an opening allowing cooling air to be sucked into said first blower from the space between said main frame and said side frames, and said second side frame comprises an opening allowing cooling air to be sucked into said second blower from the space between said main frame and said side frames.

9. A cooling module according to claim 1, wherein said light fixture comprises a lamp housing, and said LED side of said heat sink is arranged inside said lamp housing, and said flow channels comprise an outlet configured to lead said cooling air out of said housing.

10. A cooling module according to claim 9, wherein said lamp housing comprises at least one opening arranged at said LED side of said heat sink, and said at least one opening is arranged at a position away from said outlets of said first flow channel and said second flow channel.

11. A cooling module according to claim 9, wherein said cooling module comprises an outer shell part covering at least a portion of said cooling module, and said outer shell part forms a portion of said lamp housing.

12. A cooling module according to claim 11, wherein said outer shell part comprises a first flow channel turn portion connecting an outlet of said first blower and said first flow channel, and a second flow channel turn portion connecting an outlet of said second blower and said second flow channel.

13. A cooling module according to claim 11, wherein said outer shell part comprises a first outlet and a second outlet respectively arranged near an outlet of said first flow channel and an outlet of said second flow channel.

14. A moving head light fixture, comprising;

a head rotatably connected to a yoke that is rotatably connected to a base;

a pan rotating mechanism configured to rotate said yoke in relation to said base; and a tilt rotating mechanism configured to rotate said head in relation to said yoke, wherein said head includes a plurality of LEDs generating light and a cooling module, said cooling module having:

a heat sink comprising a LED side and a cooling side, where said cooling side being opposite said LED side and wherein said plurality of LEDs are arranged on a PCB at said LED side, and a first blower and a second blower, wherein at least one of the first blower and the second blower is adapted to blow cooling air to said cooling side, wherein said heat sink comprises a first linear flow channel arranged at said cooling side and a second linear flow channel arranged at said cooling side, said first flow channel and said second flow channel being arranged adjacent to each other at said cooling side, wherein said first blower is configured to blow cooling air in a first flow direction substantially parallel to the PCB through said first flow channel, and said second blower is configured to blow cooling air in a second flow direction substantially parallel to the PCB through said second flow channel, said first flow direction and said second flow direction being opposite to each other, and the cooling air in each flow channel cooling several of the plurality of LEDs, and wherein said first blower is arranged at a first angle in relation to said LED side of said heat sink, and said second blower is arranged at a second angle in relation to said LED side of said heat sink, each of said first angle and said second angle being less than 180 degrees.

15. A moving head light fixture according to claim 14, wherein said head further includes a lamp housing, and said LED side of said heat sink is arranged inside said lamp housing, and said flow channels comprise an outlet configured to lead said cooling air out of said housing.

16. A moving head light fixture according to claim 14, wherein said lamp housing comprises at least one opening arranged at said LED side of said heat sink, and said at least one opening is arranged at a position away from said outlets of said first flow channel and said second flow channel.

17. A moving head light fixture according to claim 16, wherein said cooling module comprises an outer shell part covering at least a portion of said cooling module, and said outer shell part forms a portion of said lamp housing, said outer shell part comprising:

a first flow channel turn portion connecting an outlet of said first blower and said first flow channel;

a second flow channel turn portion connecting an outlet of said second blower and said second flow channel;

a first outlet arranged near an outlet of said first flow channel; and a second outlet arranged near an outlet of said second flow channel.

18. A moving head light fixture according to claim 14, wherein said cooling module comprises a mounting frame comprising a main frame, a first side frame and a second side frame, wherein said first side frame and said second side frame are angled in relation to said main frame, said main frame comprising a central opening, and wherein said heat sink is fixed to said main frame such that said LEDs are arranged in said central opening, said first blower is arranged at said first side frame, and said second blower is arranged at said second side frame.

19. A moving head light fixture according to claim 18, wherein said first side frame comprises an opening allowing cooling air to be sucked into said first blower from a space between said main frame and said side frames, and said second side frame comprises an opening allowing cooling air to be sucked into said second blower from a space between said main frame and said side frames.

20. A moving head light fixture according to claim 14, wherein said pan rotating mechanism comprises a pan motor arranged in said yoke, and said tilt rotating mechanism comprises a tilt motor arranged in said yoke, wherein at least one of said pan motor and said tilt motor is arranged in a bottom part of said yoke and configured to partially protrude into an additional space provided by the angle arrangement of said blowers.

* * * * *